US010967219B2

(12) United States Patent
Reinhardt et al.

(10) Patent No.: US 10,967,219 B2
(45) Date of Patent: Apr. 6, 2021

(54) EXERCISE DEVICE WITH ROCKING SEAT

(71) Applicants: Ernie Reinhardt, Costa Mesa, CA (US); Sydney Reinhardt, Costa Mesa, CA (US)

(72) Inventors: Ernie Reinhardt, Costa Mesa, CA (US); Sydney Reinhardt, Costa Mesa, CA (US)

( * ) Notice: Subject to any disclaimer, the term of this patent is extended or adjusted under 35 U.S.C. 154(b) by 0 days.

(21) Appl. No.: 16/253,207

(22) Filed: Jan. 21, 2019

(65) Prior Publication Data

US 2020/0230460 A1 Jul. 23, 2020

(51) Int. Cl.

| | |
|---|---|
| ***A63B 22/00*** | (2006.01) |
| ***A63B 21/02*** | (2006.01) |
| ***A63B 21/00*** | (2006.01) |
| ***A63B 21/04*** | (2006.01) |
| *A63B 22/16* | (2006.01) |
| *A63B 22/20* | (2006.01) |

(52) U.S. Cl.

CPC .... *A63B 22/0087* (2013.01); *A63B 21/00061* (2013.01); *A63B 21/023* (2013.01); *A63B 21/0407* (2013.01); *A63B 21/4033* (2015.10); *A63B 21/4035* (2015.10); *A63B 22/0076* (2013.01); *A63B 22/00* (2013.01); *A63B 22/16* (2013.01); *A63B 22/20* (2013.01); *A63B 22/201* (2013.01); *A63B 22/203* (2013.01); *A63B 2022/0079* (2013.01)

(58) Field of Classification Search

CPC ... A63B 21/02; A63B 21/151; A63B 21/4035; A63B 21/4034; A63B 21/4045; A63B 22/0076; A63B 2022/0079; A63B 21/00061; A63B 21/023; A63B 21/0407; A63B 21/4033; A63B 22/0087; A63B 22/16; A63B 22/20; A63B 22/201; A63B 22/203

See application file for complete search history.

(56) References Cited

U.S. PATENT DOCUMENTS

| | | | | |
|---|---|---|---|---|
| 7,806,805 | B2 * | 10/2010 | Barufka | A63B 5/00 482/5 |
| 10,279,214 | B2 * | 5/2019 | Chiang | A63B 22/0076 |
| 10,449,410 | B2 * | 10/2019 | Hamilton | A63B 21/157 |
| 10,518,125 | B2 * | 12/2019 | Janowski | A63B 21/0552 |
| 2012/0100965 | A1 * | 4/2012 | Dreissigacker | A63B 21/154 482/72 |
| 2014/0011645 | A1 * | 1/2014 | Johnson | A63B 21/4033 482/121 |
| 2016/0279464 | A1 * | 9/2016 | Liu | A63B 21/005 |
| 2017/0361152 | A1 * | 12/2017 | Hou | A63B 21/005 |

* cited by examiner

*Primary Examiner* — Megan Anderson

(74) *Attorney, Agent, or Firm* — Kafantaris Law Offices; Theo Kafantaris

(57) ABSTRACT

An exercise device is disclosed which is safe to use, resists muscle adaptation, incorporates multiple methods of resistance, can quickly and easily switch between exercise modes to provide the user with the most optimal exercise routine and the least amount of hassle, and can otherwise remove the limitations of prior art machines. The exercise device can be utilized by the user to perform rowing exercises targeting cardiovascular training, high intensity training, strength training, muscle-building training and core building. Moreover, the exercise device is easy to use, will have multiple methods of operation, can quickly and easily switch between these methods of operation, and will not limit the user in the types of exercises to be performed.

16 Claims, 7 Drawing Sheets

EXERCISE DEVICE WITH ROCKING SEAT

CROSS-REFERENCE TO RELATED APPLICATIONS

This application is a continuation application and is based on and claims priority to U.S. patent application Ser. No. 15/688,863, filed on Aug. 26, 2017, which claims the benefit of U.S. Provisional Patent Application No. 62/379,893, filed on Aug. 26, 2016, both of which are incorporated herein by reference.

STATEMENT REGARDING FEDERALLY SPONSORED RESEARCH AND DEVELOPMENT

Not Applicable.

FIELD OF THE INVENTION

This invention relates generally to an exercise device, and more particularly, to a versatile device that enables the user to conduct various exercises by utilizing multiple forms of push/pull resistance mechanisms and providing a full-body workout.

DISCUSSION OF RELATED ART

Physical exercise can generally be described as a physical activity for maintaining physical fitness, boosting cardiovascular health, promoting weight loss, sharpening athletic skills, reducing stress, or improving one's general well-being. Aerobic exercise, also colloquially known as cardio, is a low intensity type of physical exercise used to expel the energy of the body and burn fat. Conversely, anaerobic exercise is a type of physical exercise where the intensity is magnified to trigger anaerobic metabolism, which builds muscle mass.

Physical exercise, especially anaerobic exercise, often includes the use of exercise machines for increased efficiency. Typically, exercise machines provide resistance to the user for weight training, where gravitational forces are utilized by the user through pulleys, levers, wheels, and other simple mechanical devices. Exercise machines commonly include a means for adjusting the amount of resistance used, typically through placing a pin through a plurality of labeled apertures.

Rowing can generally be described as propelling a watercraft with one or a pair of oars. A rowing machine is a device meant to mimic the exercise of rowing in watercraft equipped with oars for the purpose of cardiovascular exercise, strength training, or endurance. Conventional rowing machines produce resistance through a number of mechanisms, including piston resistance, break/flywheel resistance, magnetic resistance, air resistance, or water resistance. Each mechanism of resistance has advantages and disadvantages, each requiring a certain workout technique essential for performing the exercise correctly.

Many fitness machines exist in the prior art, although they generally focus on either aerobic or anaerobic exercise. Some machines, such as U.S. Pat. No. 7,803,095, allow the user to perform only strength-training exercises for certain areas, limiting the user develop other muscles. Other machines, such as U.S. Pat. No. 4,884,800, allow the user to perform only cardiovascular exercises, restricting the user from strength-training exercises as well as muscle-building exercises.

When optimizing an exercise routine, it is beneficial to consider movements that are not being used optimally. For example, traditional rowing machines will provide resistance when pulling, but not when pushing. Some exercise machines can be manipulated to provide resistance when pulling, but require the user to reconfigure the machine for this specific benefit, disrupting their exercise routine and providing unnecessary delays when exercising.

While several exercise machines exist for cardiovascular and strength-training exercise, they often cannot be used optimally without reconfiguring the machines for a specific purpose. Furthermore, they are static in nature and do not provide a true "on the water" experience. Lastly, current machines have proven to be strenuous on the body, joints, and heart, and can lead to muscle adaptation where gains decrease after recurring use. Therefore, a need exists for a device which is safe to use, resists muscle adaptation, incorporates multiple methods of resistance, address's the static nature of current machines, and can quickly and easily switch between exercise modes to provide the user with the most optimal exercise routine and the least amount of hassle. The present invention satisfies these needs.

SUMMARY OF THE INVENTION

The present invention will provide a device which is safe to use, resists muscle adaptation, incorporates multiple methods of resistance, can quickly and easily switch between exercise modes to provide the user with the most optimal exercise routine and the least amount of hassle, and can otherwise remove the limitations of prior art machines. The present invention satisfies these needs, as it can be utilized by the user to perform rowing exercises targeting cardiovascular training, high intensity training, strength training, muscle-building training and core building. Moreover, the present invention is easy to use, will have multiple methods of operation, can quickly and easily switch between these methods of operation, and will not limit the user in the types of exercises to be performed.

The present invention is comprised of a plurality of components, including a frame, pair of platforms, rail system, carriage assembly, foot support, resistance mechanism, a pair of utility bars, and a pair of resistance grips. These components combine to form a rowing machine that is multifunctional, more efficient and easier to use than traditional rowing machines. The present device allows the user to perform strength-training exercises, core-training exercises, flexibility/lengthening, and cardio and will create new lean muscle mass, target a variety of muscle groups, perform a true cardio workout and offer a HIIT style routine to shred fat.

These and other objectives of the present invention will become obvious to those of ordinary skill in the art after reading the following detailed description of the preferred embodiments. It is to be understood that the foregoing general description and the following detailed description are exemplary, and are intended to provide further explanation of the invention as claimed.

DETAILED DESCRIPTION OF THE PREFERRED EMBODIMENT

Figure 1:
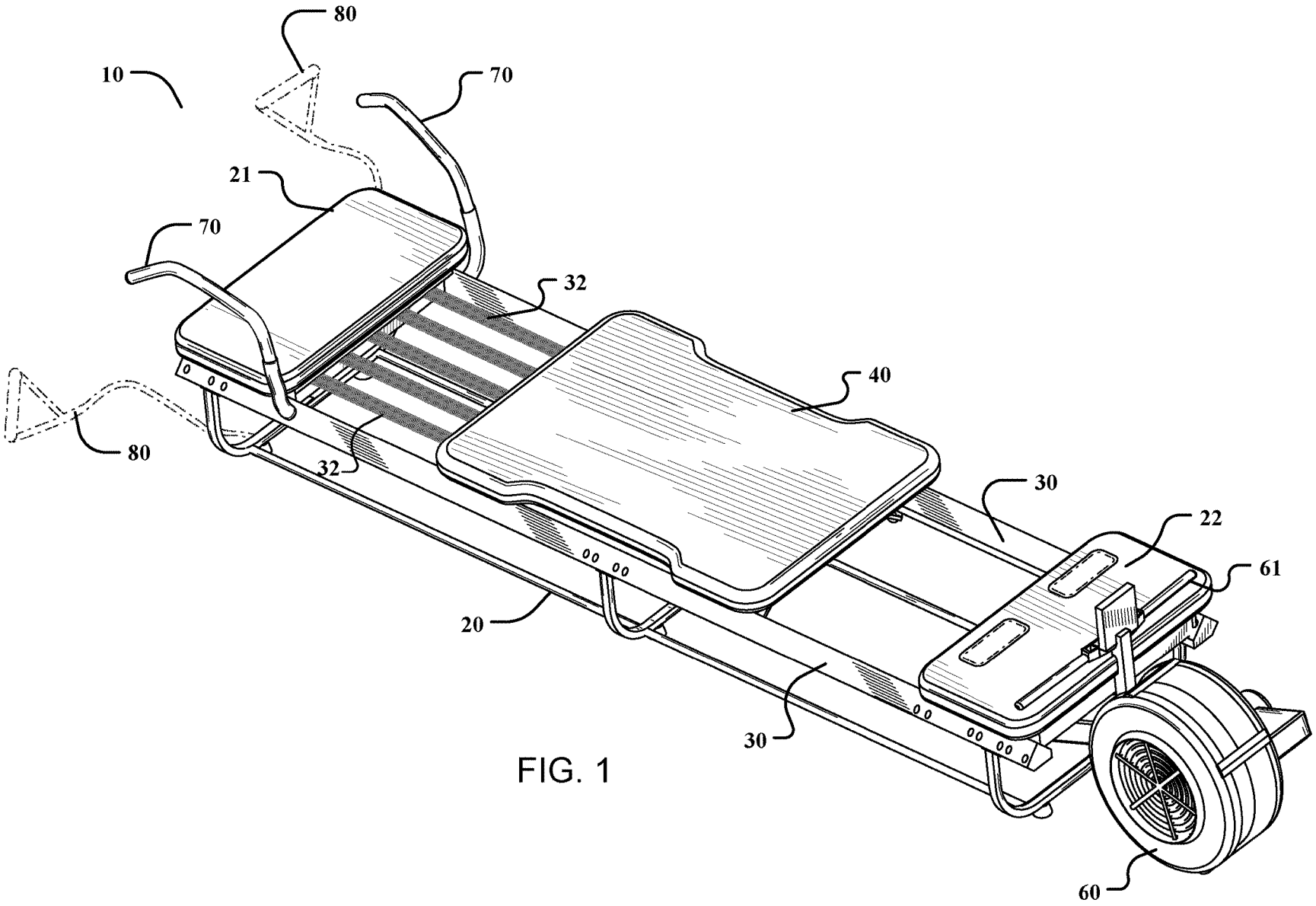
FIG. 1 is a diagram illustrating a top perspective view of the exercise device according to one embodiment of the invention.
Figure 2:
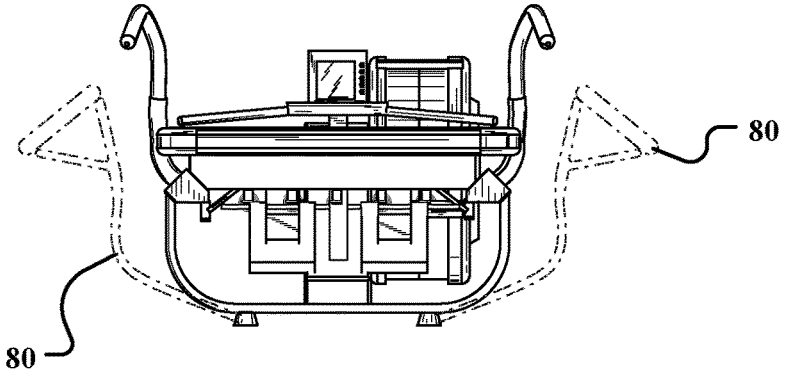
FIG. 2 is a diagram illustrating a front view of the present invention.
Figure 3A:
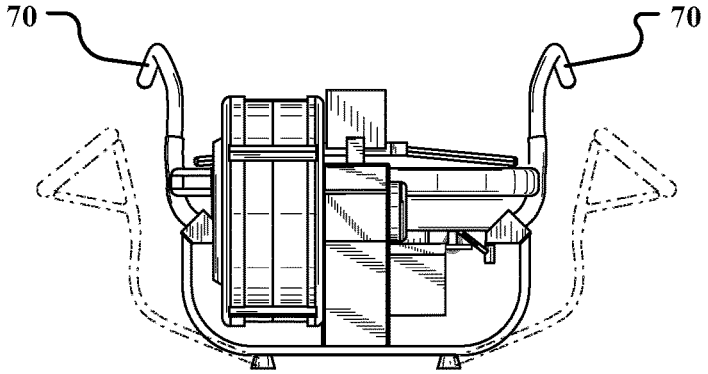
FIG. 3A is a diagram illustrating a rear view of the present invention.
Figure 3B:
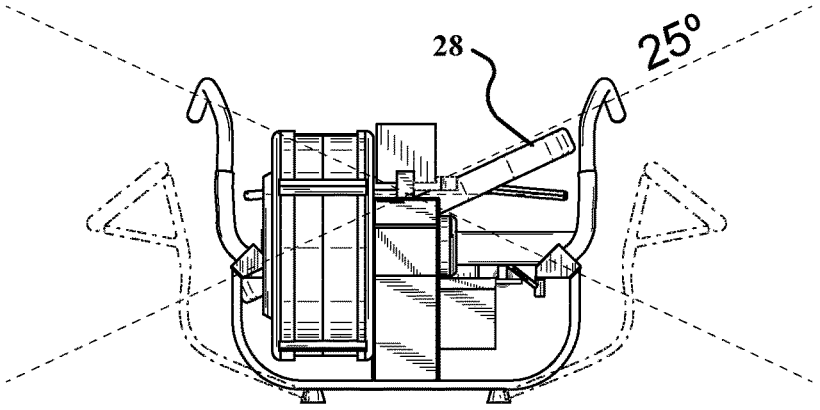
FIG. 3B is a diagram illustrating a rear view of the present invention, illustrating the rocking seat rotating 250.
Figure 4:
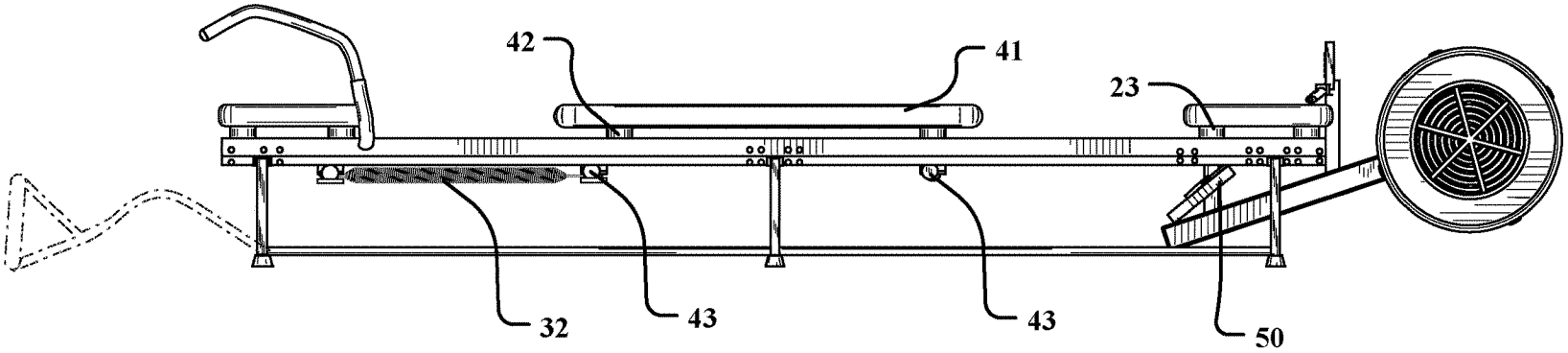
FIG. 4 is a diagram illustrating a right side view of the present invention.
Figure 5:
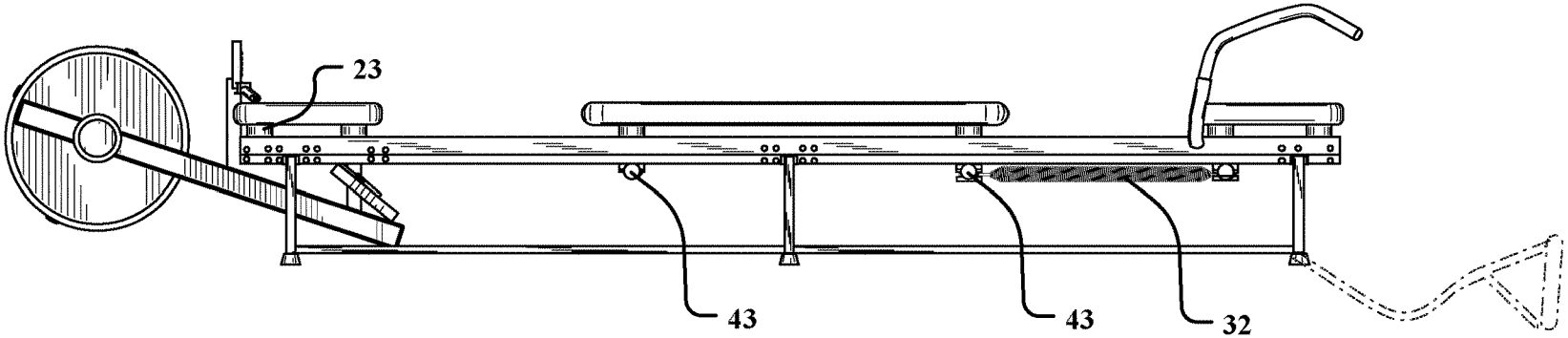
FIG. 5 is a diagram illustrating a left side view of the present invention.
Figure 6:
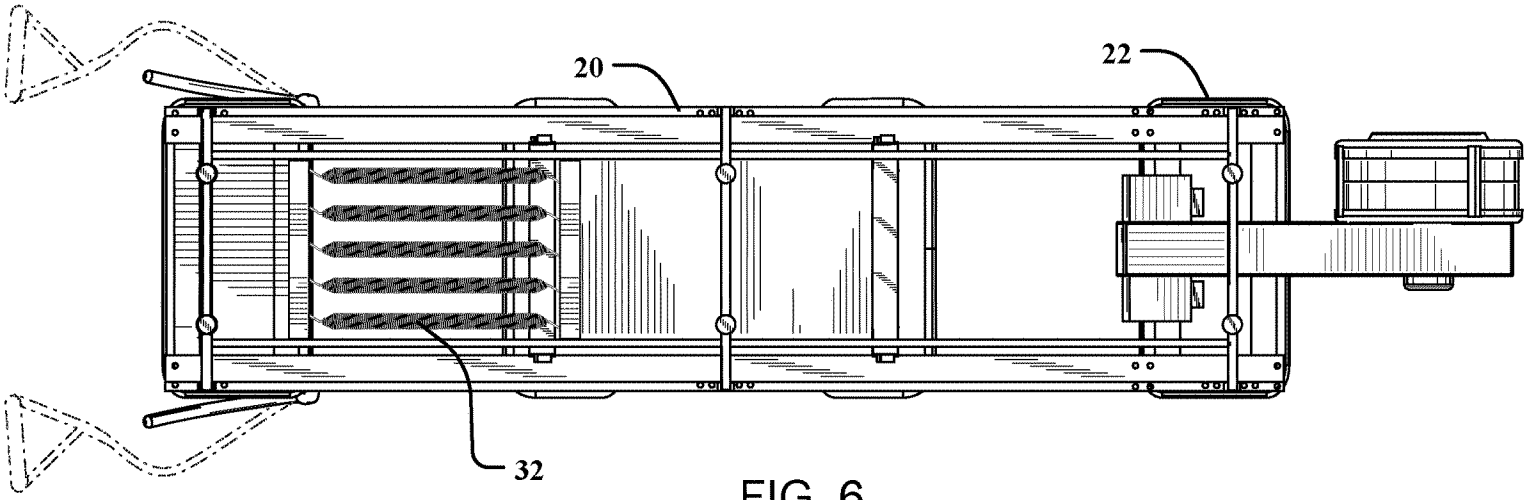
FIG. 6 is a diagram illustrating a bottom view of the present invention.
Figure 7A:
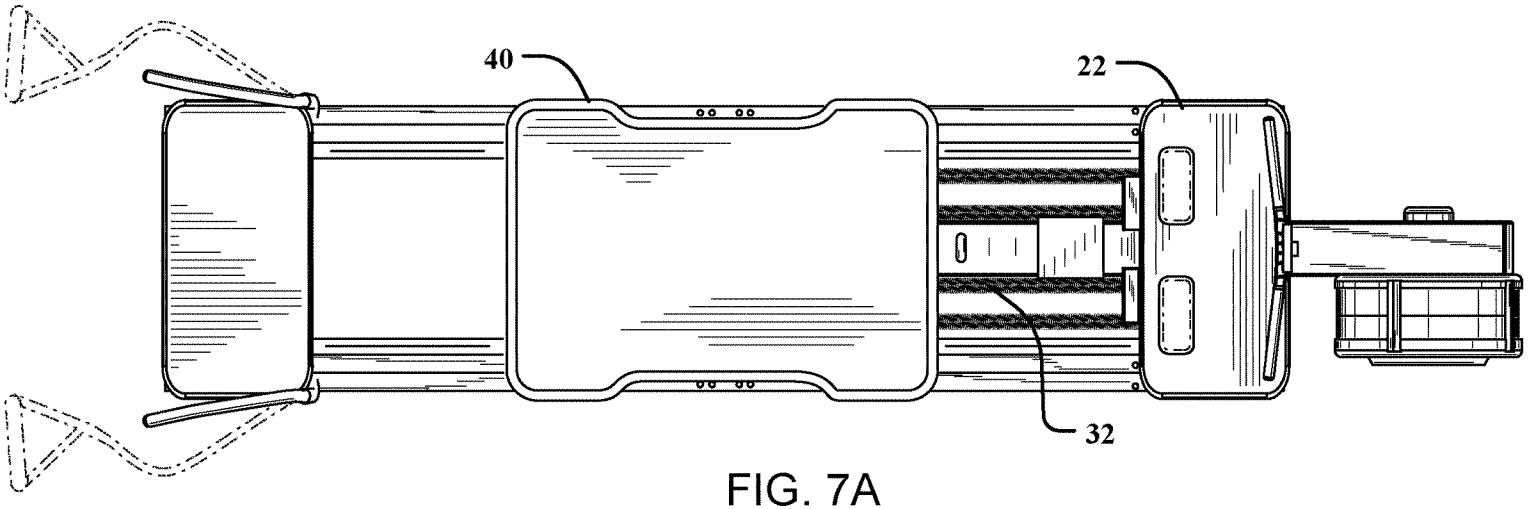
FIG. 7A is a diagram illustrating a top view of the present invention.
Figure 7B:
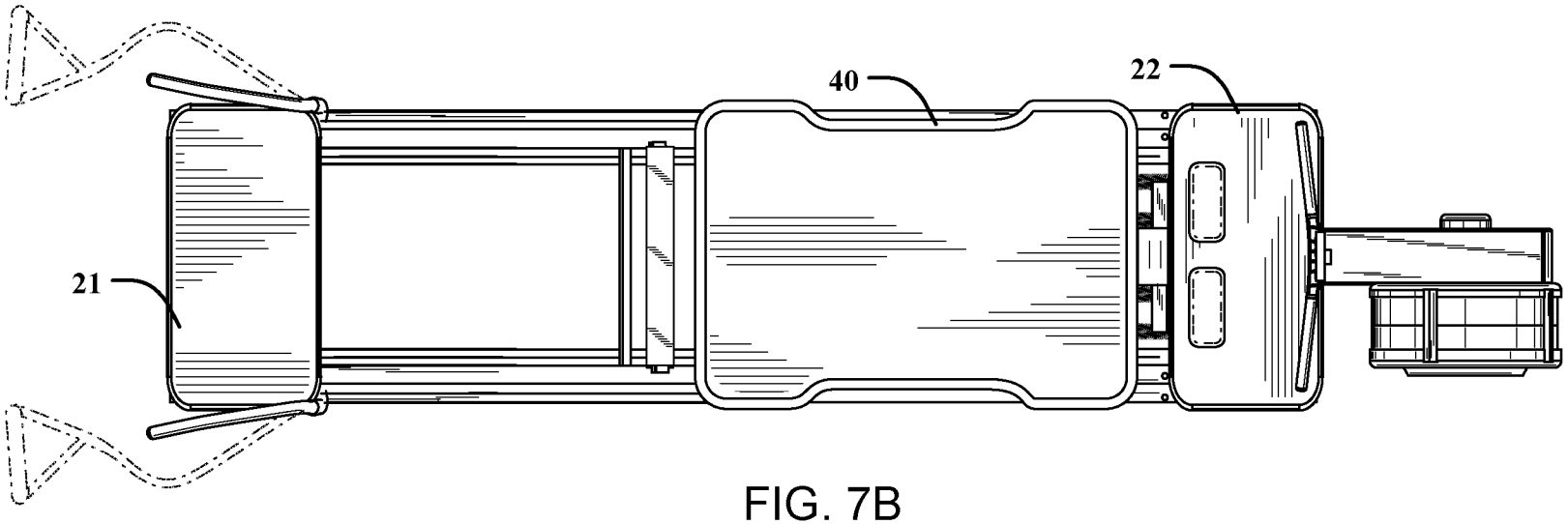
FIG. 7B is a diagram illustrating a top view of the present invention with carriage moved toward the rocking seat.
Figure 8:
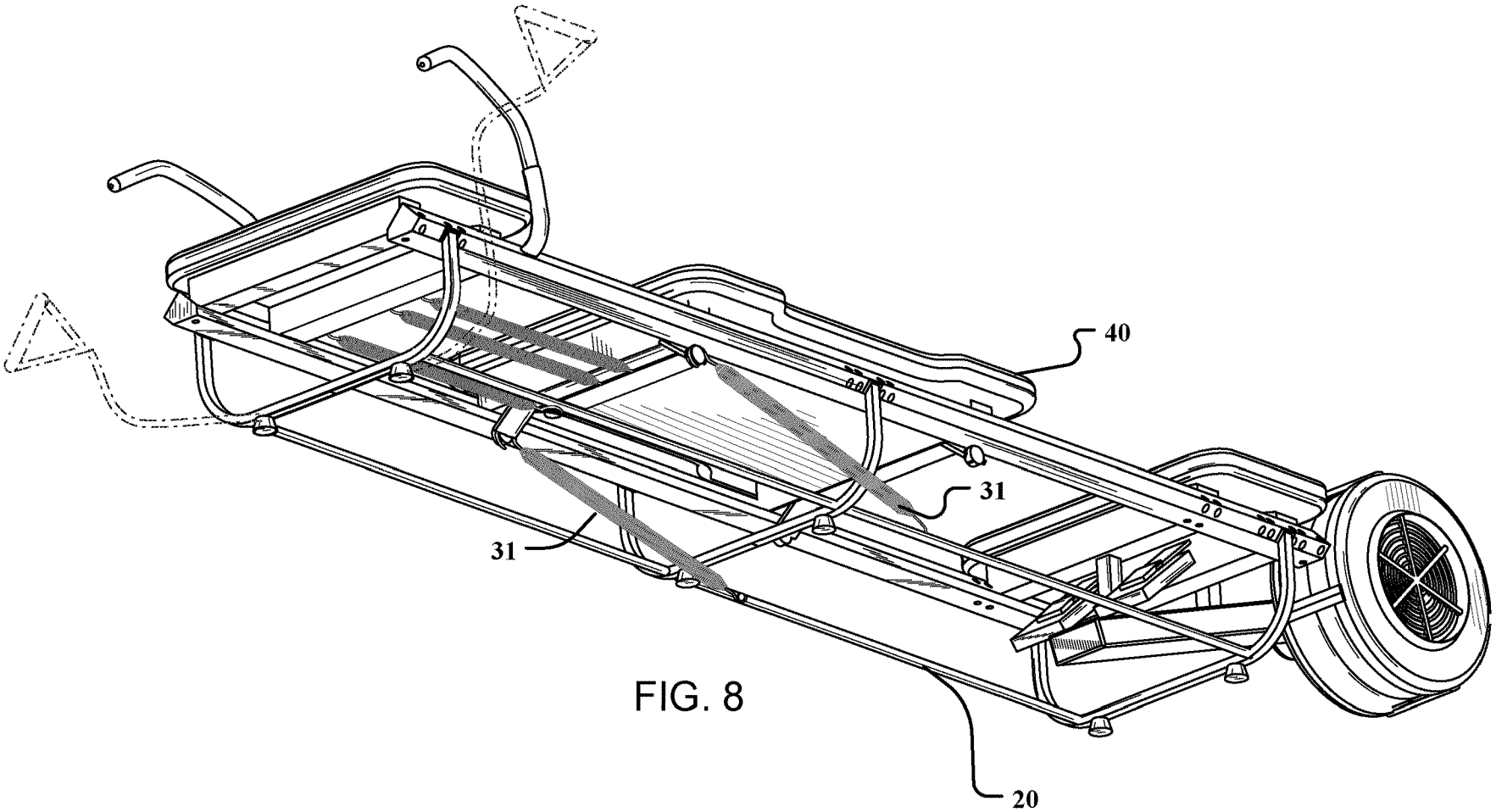
FIG. 8 is a diagram illustrating a bottom perspective view of the present invention.
Figure 9:
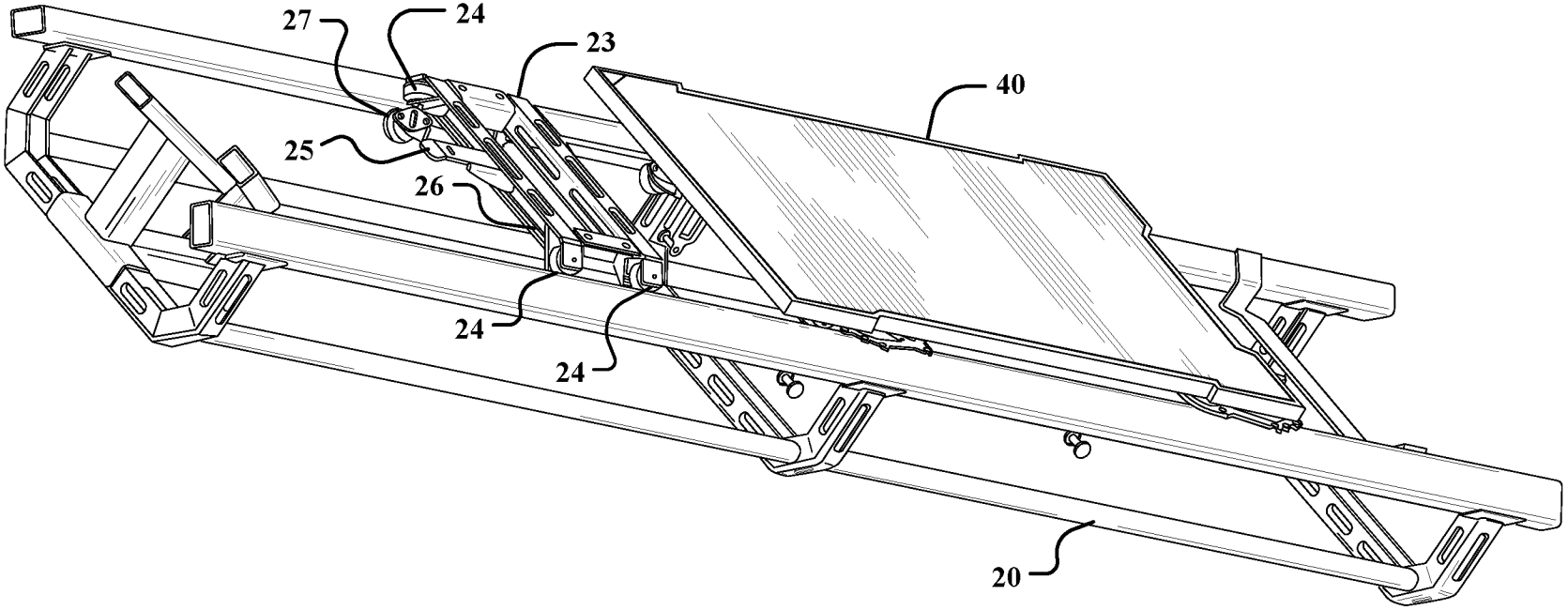
FIG. 9 is a diagram illustrating a top perspective view of the exercise device with rocking seat removed.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

The present invention 10 comprises a frame 20, pair of platforms 21, 22, rail system 30, carriage assembly 40, foot support 50, resistance mechanism 60, a pair of utility bars 70, and a pair of opposing resistance grips 80. The frame 20 functions as the main source of structural support for the device. The pair of platforms 21, 22 enables the user to perform various additional exercises. The rail system 30 is adapted to provide a track for the carriage assembly 40 to move along. The carriage assembly 40 is adapted to provide a place for the user to sit down while operating the device. The foot support 50 functions as a support base for the user's feet. The resistance mechanism 60 provides resistance for the device. The pair of utility bars 70 are adapted to rotate, permitting the user to incorporate several other exercises while using the present invention. The pair of resistance grips 80 enable the user to perform additional push/pull exercises. Each of these components will be discussed in detail below.

The frame 20 comprises a base from which all other components attach, and as such, provides structural integrity to the device. Specifically, the rail system 30, foot support 50, and resistance mechanism 60 are all fixedly attached to the frame 20. The frame 20 comprises a proximal end and a distal end, and provides open access to all components. The frame 20 is made of strong, durable materials, such as steel, aluminum, or other alloys adapted for rigidity and strength. In an alternative embodiment, the frame 20 may be coated with a rubberized material to provide additional protection for additional safety.

A pair of platforms 21, 22 are positioned at the proximal end and distal ends of the device. In the preferred embodiment, the first platform 21 is fixed at the proximal end, while the second platform, or rocking platform, 22 is adapted to rock and slide along the rail system 30 at the distal end. The rocking platform 22, is intended to provide users with additional flexibility when performing exercises, enabling them to face the opposite direction when exercising and requiring them to stabilize their body, which for build their core muscles while exercising. In an alternative embodiment, the platforms 21, 22 are fixed and do not move. In a further alternative embodiment, the platforms 21, 22 further comprises a plurality of spring attachment points from which one or a plurality of compression springs may be attached.

The rail system 30 comprises a pair of opposing rails fixedly attached to the frame between said proximal and distal ends and adapted to glide the carriage assembly 40 along the rails. Specifically, the rails of the rail system 30 are positioned horizontally and provide a track along which said carriage assembly 40 may move freely. The rail system 30 provides lateral movement for the carriage assembly 40 ranging between 2 and 6 feet and are constructed of a strong, durable material such as steel, aluminum, or other alloys adapted for rigidity and strength. In the preferred embodiment, the rails 30 are angled and have an angle of 45 degrees, although any suitable range between 15-75 degrees can be used.

The carriage assembly 40 comprises a molded seat 41 for support while functioning and/or rowing (on the rowing end of the machine), a carriage support 42, and a plurality of wheels 43. The carriage assembly 40 is frictionally attached to the rail system via the wheels 43 and is adapted to move freely between said proximal and distal ends of the frame 20. The wheels 43 are paired and positioned on either side of the rails such that the carriage assembly 40 cannot be removed. More specifically, the wheels 41 are positioned adjacent to the rails such that the carriage assembly 40 will remain frictionally attached to the rails in any orientation while providing a free range of movement. When using the device 10, the carriage assembly 40 will travel while the user is seated, simulating a true rowing experience. In an alternative embodiment, the carriage assembly 40 further comprises a plurality of spring attachment points from which one or a plurality of compression springs 32 may be attached.

In an alternative embodiment, the carriage assembly 40 further comprises a rotation mechanism which generally destabilizes the user, requiring more effort to conduct the desired exercise. More specifically, the rotation mechanism is rotationally attached between the seat 41 and the carriage support 42, permitting the seat to rock and rotate side to side, simulating the movement of being in a boat or watercraft. This allows the user to engage more of their core during exercises while also simulating the most realistic experience of rowing, greatly enhancing the difficulty of any exercise. For instance, when any type of lunge exercise is preformed, the user must first stabilize themselves with their core on the platform or foot rest and the carriage. The rotation mechanism is adapted to tilt left/right and or forward/back at a range of up to 50 degree's range of motion (up to +/−25 degrees from center, left or right from center and or forward and back). In an alternative embodiment, the rotation mechanism may be kept in a fixed position and this system can be controlled by resistance springs (rather than constant tension or progressive springs) to allow for safety and enable the user to gradually build up their core strength.

The foot support 50 is positioned at the distal end of the frame and provides a support for the user to place their feet. The foot support 50 further comprises a pair of foot straps to secure the user's feet to the foot support 50. Furthermore, the foot support 50 is ergonomically angled for comfort and safety, with a range between 15-75 degrees, with a preferred angle of 45 degrees. During a rowing exercise, the user will use the foot support 50 as a base to push from and propel backwards. In the preferred embodiment, the foot support 50 is coated with a tacky or otherwise high friction material such that the user's feet will remain frictionally attached to the foot support during exercise.

The rocking platform 22 is adapted to sway left or right up to 25 degrees while at the same time sliding on the rail system 30. This will provide the user with additional exercise options, as the rocking platform 22 will enable the user to face the opposing direction while still strengthening their core. The rocking platform 22 comprises a rocking seat 23 for supporting the user while exercising, a plurality of rocking arms 24, a plurality of rocking wheels 25, a rocking tray 26, and a plurality of sliding wheels 27. The plurality of rocking arms 24 attach the rocking wheels 25 to the rocking seat 23. The rocking tray 26 is curved and the rocking wheels 25 are positioned along the rocking tray 26 such that they enable the rocking seat 23 to sway left or right up to 25 degrees. A plurality of stops obstruct the movement of the rocking wheels 25 such that they cannot extend beyond 25 degrees. The rocking platform 22 is frictionally attached to the rail system 30 through the sliding wheels 27. The sliding wheels 24 are attached to the rocking tray 26 and are paired and positioned on either side of the rails 30 such that the rocking platform 22 cannot be lifted above the rails 30 or fall below it.

A locking mechanism 28 is adapted to lock the rocking platform 22 in a fixed position for specific exercises. For example, if the user needs a fixed platform on the distal end of the device, they can use the locking mechanism 28 to fix the rocking platform 22 on the distal end, preventing it from rocking or sliding along the rails 30. The locking mechanism 28 comprises an engagement means on the foot support 50 and an aperture positioned on the distal end of the rocking platform 22 adapted to align with the engagement means when the rocking platform 22 is positioned at the distal end of the device. More specifically, the engagement means of the foot support 50 is a T-shaped handle and pin that is under compression. The T-shaped handle must first be lifted, raising the pin above the aperture. When the rocking platform 22 is positioned such that the pin and aperture are aligned, the T-shaped handle will be released and the pin will release through the aperture, preventing the rocking seat 22 from moving or swaying. To release the rocking platform 22, the T-shaped handle will be lifted and the rocking platform 22 will be pulled away, separating the pin from the aperture and freeing the rocking platform 22 to slide and sway.

The resistance mechanism 60 is fixedly attached to the frame 20 at the distal end and comprises a rotational fan-based resistance element. The resistance mechanism 60 further comprises a rowing bar 61 and cable, where the rowing bar is mechanically attached to the resistance mechanism 60. Furthermore, a bracket is provided on the cable between the rowing bar 61 and resistance mechanism 60 that allows the user to replace the rowing bar 61 with any of a plurality of attachments for various exercises. The cable is attached to the resistance mechanism 60 at its proximal end and the rowing bar 61 is attached at its distal end. The resistance mechanism 60 is designed to simulate rowing and increase resistance on the catch motion and drive motion of the row. The catch motion is when the initial friction kicks in and the drive motion is when the legs are pushing away from the foot platform, where the pull is smooth for the follow through but resistance is limited and begins to dissipate.

The pair of utility bars 70 are fixedly attached to the frame adjacent to the carriage assembly 40 at the proximal end of the device. The utility bars 70 are designed as a single bar system with a 45-degree angle placed in the center bar span to offer better joint stability while performing exercises. This also allows for multiple exercises not accustomed to current machines and allows for quicker exercise transitions. Each utility bar incorporates rubber grips for user functionality and comfort. In an alternative embodiment, a pair of utility bars 70 are also positioned at the distal end of the device. In a further alternative embodiment, each utility bar 70 does not rotate and further comprises an extension spring such that, as rotation and/or pivoting increases, additional resistance is exerted.

The pair of opposing resistance grips 80 are attached to the frame adjacent to the carriage assembly 40 at the distal end of the device. The pair of resistance grips 80 comprise a pair of grip handles and a pair of resistance springs or bands. The grips are coated with a soft, tacky substance such as rubber which helps the user to grip the device while exercising. The resistance bands are adapted to quickly connect and disconnect, enabling the user to provide varying tension levels for their specific exercise needs. The pair of resistance grips 80 can be used along with other parts of the invention to provide a truly unique exercise experience, or can be used alone for a variety of exercises.

In an alternative embodiment, a plurality of resistance spring attachments 32 are removable and attached between the platforms 21, 22 and carriage assembly 40. Specifically, tension spring attachments are used, which offer a continuous tension with greater resistance at the final extension with a range between 30"-50". These tension springs are removably attached between the carriage assembly 40 and platforms 21, where each resistance spring attachment 32 provides a specified resistance level. For example, each spring may represent a weight such as 5, 12, or 20 lbs. Up to 6 springs can be attached to each platform 21, 22, with the user manually attaching/detaching the springs 32 so as to provide a desired level of resistance. As such, the user is now able to incorporate additional exercises that benefit from the carriage assembly 40 being both free moving and having extension resistance. Otherwise, the extended tension will allow the user to fully extend reaching the desired weight tension. Each spring 32 is adapted to quickly attach and detach such that they may be quickly swapped in the middle of an exercise. More specifically, a quick latch system is used to attach and detach the springs quickly and easily.

In a further alternative embodiment, a plurality of carriage spring attachments 31 can be used to increase the resistance when exercising using the carriage assembly 40. As an example, a typical rowing motion will provide resistance when pulling, but does not provide resistance when pushing. Using the carriage spring attachments 31, the user will experience resistance both during pushing and pulling, increasing the intensity of their workout. The carriage spring attachments are positioned between the carriage assembly 40 and frame 20. These springs are tension springs and are removable if desired, and can be replaced with springs having a desired level of resistance.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An exercise device, comprising:

a frame configured to provide structural support for the exercise device, said frame further comprising a proximal end and a distal end;

a rail system positioned above said frame;

a carriage assembly configured to glide along said rail system, said carriage assembly further comprising a carriage seat;

a foot support configured to provide support for a user's feet during exercise;

a resistance mechanism configured to provide resistance during exercise, said resistance mechanism further comprising a rowing handle;

a pair of opposing utility bars configured to provide additional exercises for the user; and a pair of opposing resistance grips;

wherein the user is capable of sitting on the carriage assembly, push from the foot support, and pull the rowing handle, simulating a true rowing experience; a rocking platform slidably attached to said rail system on said distal end.

2. The exercise device according to claim 1, wherein said rocking platform further comprises a rocking seat, a plurality of rocking wheels, and a rocking tray.

3. The exercise device according to claim 2, wherein a plurality of rocking arms attach said plurality of rocking wheels to said rocking seat.

4. The exercise device according to claim 3, wherein said rocking tray is curved and wherein said plurality of rocking wheels are positioned along said rocking tray such that said plurality of wheels roll about said rocking tray, enabling said rocking platform to sway left or right.

5. The exercise device according to claim 1, wherein said rocking platform further comprises a locking mechanism configured to lock said rocking platform in a fixed position for specific exercises.

6. The exercise device according to claim 5, wherein said locking mechanism further comprises an engagement means and an aperture, wherein said engagement means obstructs movement by aligning with and engaging said aperture.

7. The exercise device according to claim 1, further comprising a platform on said proximal end, wherein a plurality of removeable resistance spring attachments are positioned between said platform and said carriage assembly, providing additional exercise resistance.

8. The exercise device according to claim 7, wherein said plurality of removable resistance spring attachments further comprise up to 6 spring attachments of various resistances configured to quickly attach and detach.

9. The exercise device according to claim 1, wherein said rocking platform further comprises a rocking range of 25 degrees to the left or right.

10. The exercise device according to claim 1, wherein said rocking platform further comprises a plurality of sliding wheels, wherein said plurality of sliding wheels are frictionally attached to said rail system such that said rocking platform is configured to slide along said rail system.

11. The exercise device according to claim 1, wherein said pair of opposing resistance grips each further comprise a grip handle and a resistance band, wherein each of said resistance bands are configured to quickly connect and disconnect to said frame.

12. The exercise device according to claim 1, wherein said carriage assembly is configured to move horizontally along said rail system, and wherein said rail system further comprises an angled edge.

13. The exercise device according to claim 1, wherein said carriage assembly further comprises a plurality of carriage support wheels for frictionally attaching to said rail system.

14. The exercise device according to claim 1, further comprising a plurality of carriage spring attachments removably attached between said carriage assembly and said frame, wherein said plurality of carriage spring attachments increase the resistance when using said carriage assembly.

15. The exercise device according to claim 1, wherein said pair of opposing utility bars further comprise a 45 degree bend.

16. The exercise device according to claim 1, wherein said foot support is positioned at the distal end of the exercise device and is configured to pivot between up or down by 30 degrees with a preferred angle of 45 degrees.

* * * * *